US009312641B2

(12) United States Patent
Wang et al.

(10) Patent No.: US 9,312,641 B2
(45) Date of Patent: Apr. 12, 2016

(54) ELECTRICAL CONNECTOR USED FOR TRANSMITTING HIGH FREQUENCY SIGNALS

(71) Applicant: HON HAI PRECISION INDUSTRY CO., LTD., New Taipei (TW)

(72) Inventors: Qiang Wang, Kunshan (CN); Liu-Tao Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/318,595

(22) Filed: Jun. 28, 2014

(65) Prior Publication Data

US 2015/0004839 A1 Jan. 1, 2015

(30) Foreign Application Priority Data

Jun. 28, 2013 (CN) ..... 2013 2 0378153 U

(51) Int. Cl.

| | |
|---|---|
| ***H01R 24/00*** | (2011.01) |
| ***H01R 33/00*** | (2006.01) |
| ***H01R 13/648*** | (2006.01) |
| ***H01R 13/6585*** | (2011.01) |
| *H01R 13/506* | (2006.01) |
| *H01R 13/6594* | (2011.01) |
| *H01R 13/6597* | (2011.01) |
| *H01R 107/00* | (2006.01) |

(52) U.S. Cl.

CPC ..... *H01R 13/6585* (2013.01); *H01R 13/506* (2013.01); *H01R 13/6594* (2013.01); *H01R 13/6597* (2013.01); *H01R 2107/00* (2013.01)

(58) Field of Classification Search

CPC ..... H01R 13/6585; H01R 13/6597; H01R 13/6598; H01R 13/6581; H01R 12/724; H01R 12/721

USPC ..... 439/660, 607.09, 607.08, 607.05, 439/607.4, 607.12, 607.13, 607.15

See application file for complete search history.

(56) References Cited

U.S. PATENT DOCUMENTS

| | | | | |
|---|---|---|---|---|
| 5,984,725 | A * | 11/1999 | Belopolsky et al. | 439/607.31 |
| 6,183,300 | B1 * | 2/2001 | Belopolsky et al. | 439/607.4 |
| 6,273,757 | B1 * | 8/2001 | David et al. | 439/607.13 |
| 6,296,521 | B1 * | 10/2001 | Chang et al. | 439/607.4 |
| 7,625,245 | B1 * | 12/2009 | Yao | 439/660 |
| 7,628,655 | B1 * | 12/2009 | Chen | 439/660 |
| 7,758,379 | B2 * | 7/2010 | Chen | 439/607.11 |
| 8,109,795 | B2 * | 2/2012 | Lin et al. | 439/660 |

(Continued)

FOREIGN PATENT DOCUMENTS

| | | |
|---|---|---|
| JP | 4234714 | 6/2007 |
| TW | I442650 | 4/2010 |

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulative housing defining a base portion and a tongue portion extending forwardly from the base portion, the tongue portion defines a first surface and a second surface disposed oppositely. A first terminal module is retained in the insulative housing and exposed on the first surface. And a shielding member is embedded in the tongue portion of the insulative housing and located between the first surface and the second surface. The first terminal module defines at least one grounding contact, the grounding contact defines a connecting portion projecting toward and contacting with the shielding member.

17 Claims, 6 Drawing Sheets

(56) References Cited

U.S. PATENT DOCUMENTS

| | | | | |
|---|---|---|---|---|
| 8,251,746 | B2 * | 8/2012 | Zhang et al. | 439/607.11 |
| 8,851,927 | B2 * | 10/2014 | Hsu et al. | 439/607.11 |
| 2007/0197093 | A1 * | 8/2007 | Chen et al. | 439/607 |
| 2011/0097946 | A1 * | 4/2011 | Chen | 439/708 |
| 2011/0159747 | A1 * | 6/2011 | Tung et al. | 439/660 |

* cited by examiner

ELECTRICAL CONNECTOR USED FOR TRANSMITTING HIGH FREQUENCY SIGNALS

BACKGROUND OF THE INVENTION

1. Field of the Invention

The present invention relates to an electrical connector, and more particularly to an electrical connector used for transmitting high-frequency signals.

2. Description of the Related Art

With the social development, it is a trend for a high-speed signal transmission and the electrical connectors are being developed with the high-speed signal transmission. However, there are some problems of signal transmission, such as signal interference between the terminals, and these problems will affect the high frequency performance of the electrical connector.

Therefore, an improved electrical connector is highly desired to meet overcome the requirement.

BRIEF SUMMARY OF THE INVENTION

An object of the present invention is to provide an electrical connector which is conducive to improving high-frequency performance.

In order to achieve above-mentioned object, an electrical connector includes an insulative housing defining a base portion and a tongue portion extending forwardly from the base portion, the tongue portion defines a first surface and a second surface disposed oppositely. A first terminal module is retained in the insulative housing and exposed on the first surface. And a shielding member is embedded in the tongue portion of the insulative housing and located between the first surface and the second surface. The first terminal module defines at least one grounding contact, the grounding contact defines a connecting portion projecting toward and contacting with the shielding member.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
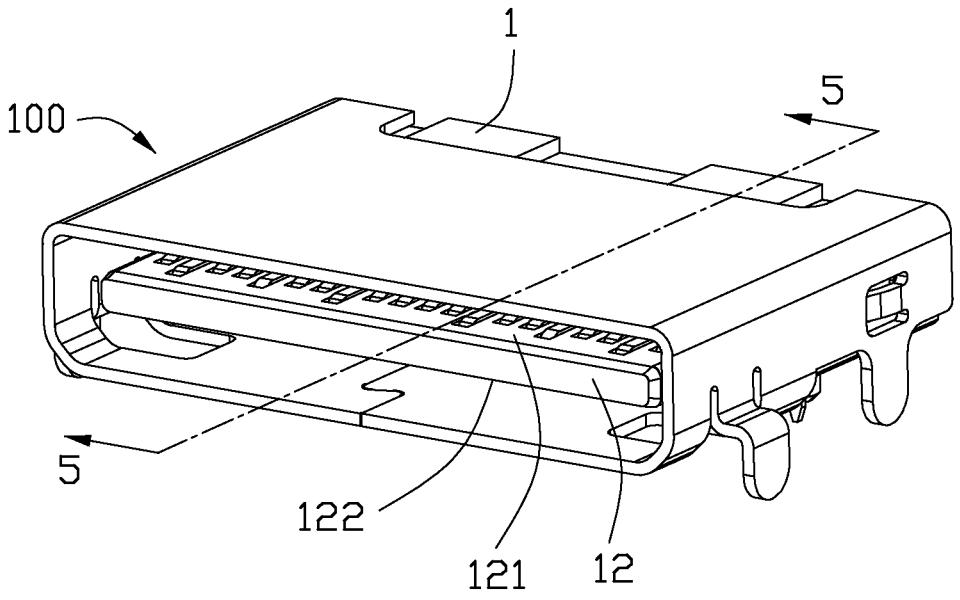
FIG. 1 is a perspective view of an electrical connector in accordance with the present invention.
Figure 2:
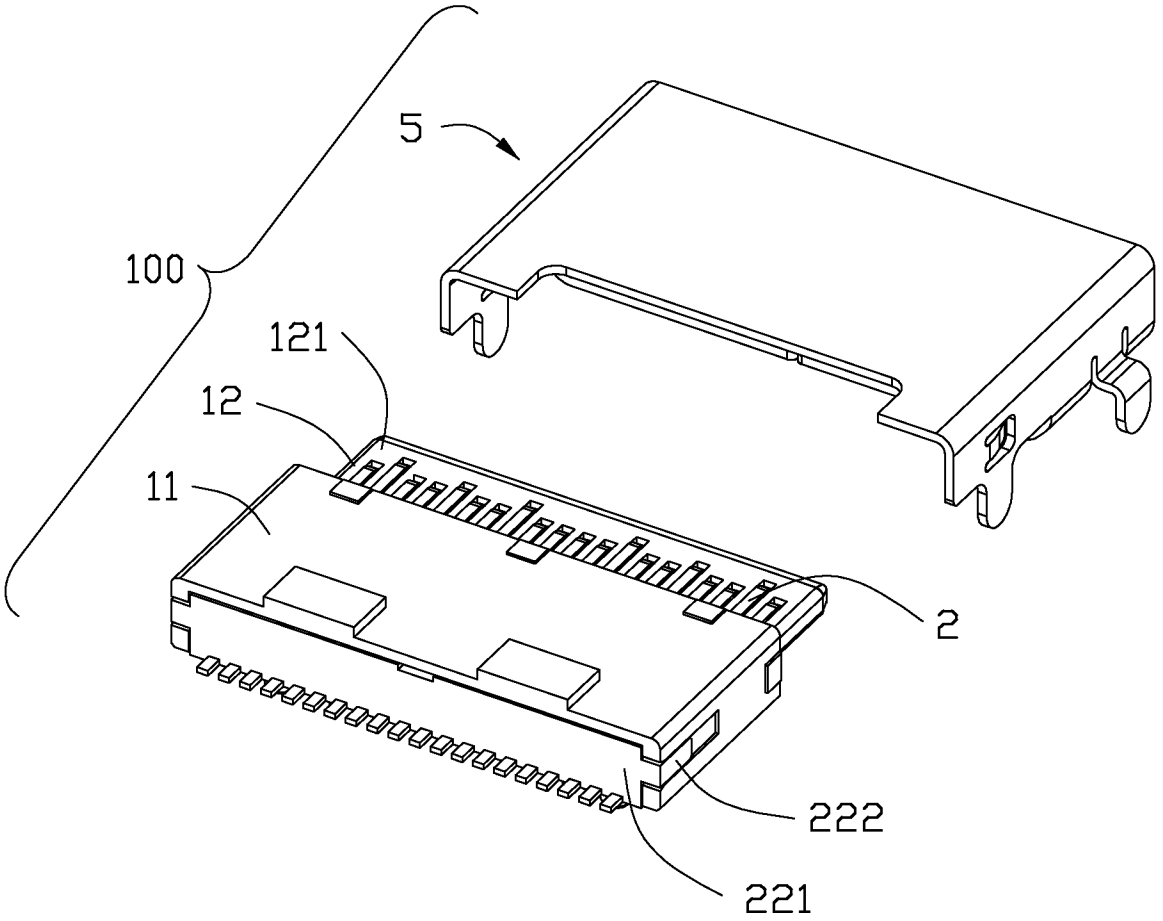
FIG. 2 is a partly exploded perspective view of the electrical connector shown in FIG. 1.
Figure 3:
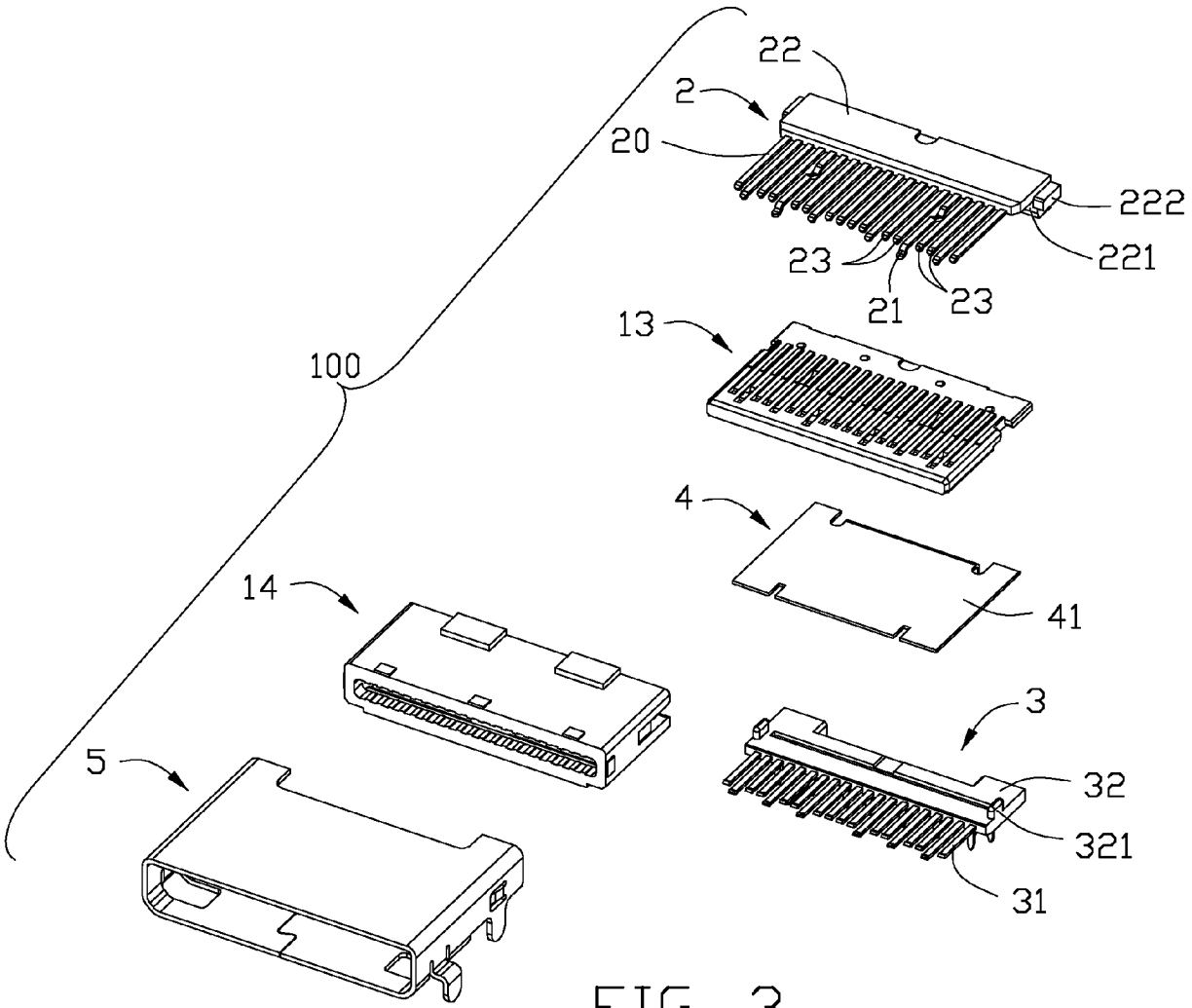
FIG. 3 is an exploded perspective view of the electrical connector shown in FIG. 1.
Figure 4:
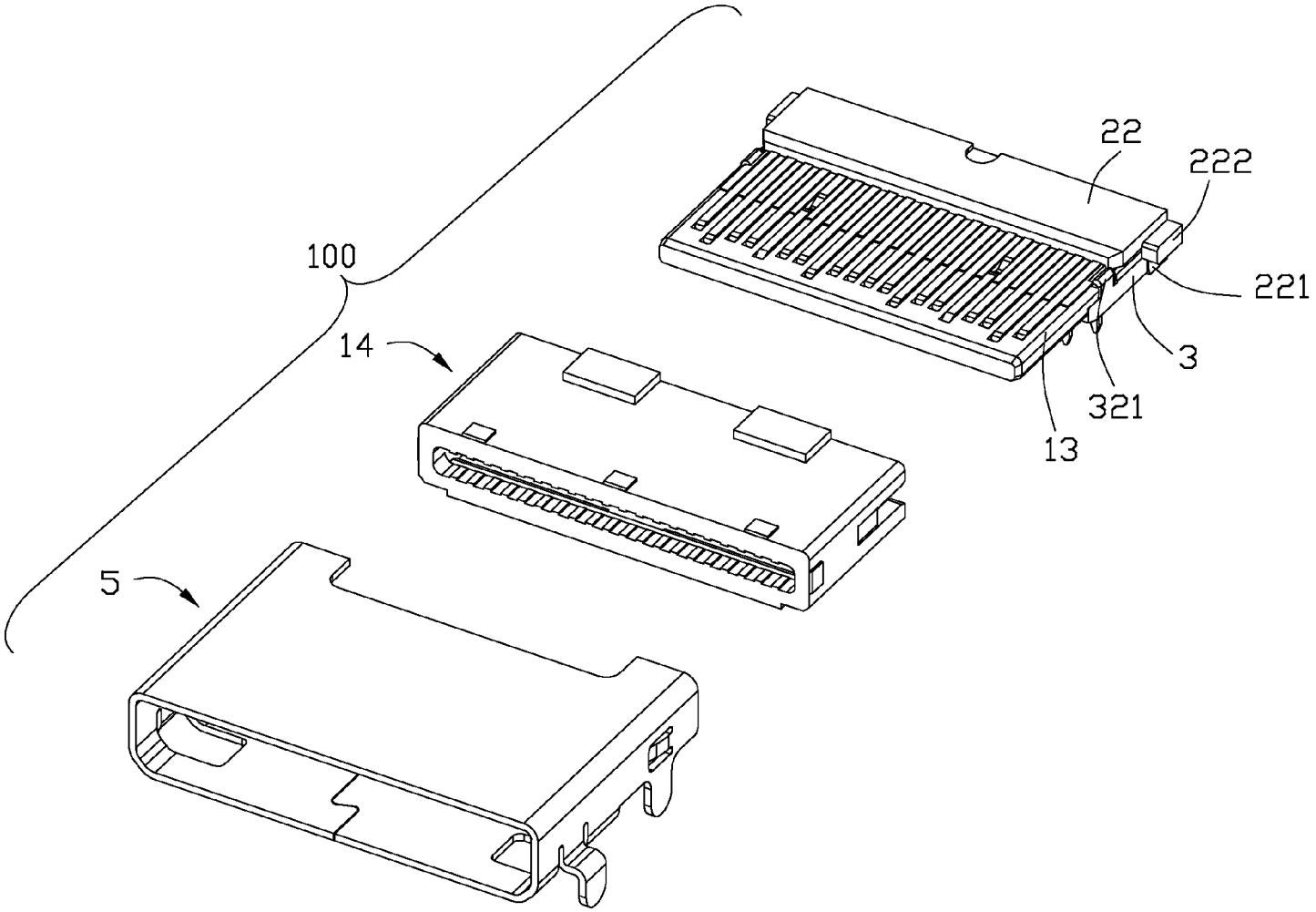
FIG. 4 is another partly exploded perspective view of the electrical connector shown in FIG. 1.
Figure 5:
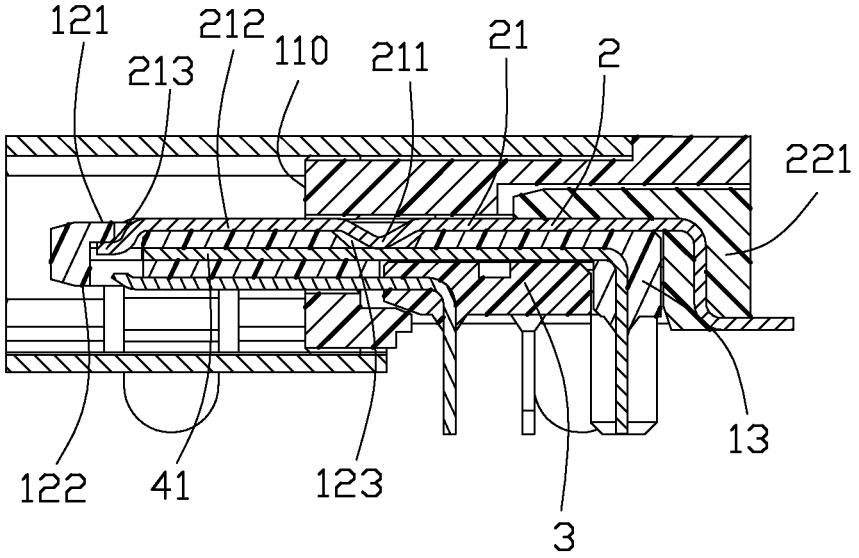
FIG. 5 is a cross-sectional view of the electrical connector taken along lines 5-5 of FIG. 1.
Figure 6:
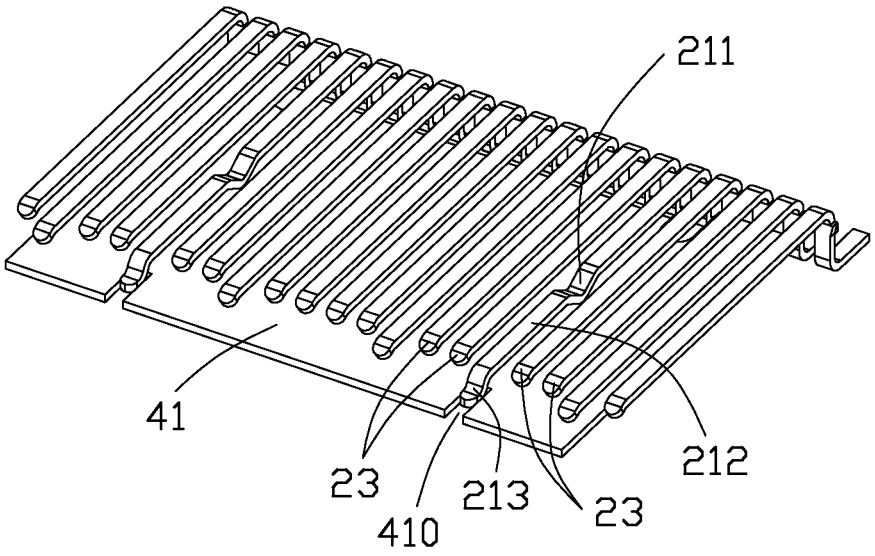
FIG. 6 is a perspective view shows a plurality of first terminals mating a shielding member of the electrical connector.

Reference will now be made to the drawing figures to describe a preferred embodiment of the present invention in detail. Referring to FIG. 1 to FIG. 3, an electrical connector 100 includes an insulative housing 1, a first terminal module 2 and a second terminal module 3 retained in the insulative housing 1, a shielding member 4 embedded in the insulative housing 1 and a metallic shell 5 surrounding the insulative housing 1. The insulative housing 1 defines a base portion 11 and a tongue portion 12 extending forwardly from the base portion 11, the tongue portion 12 defines a first surface 121 and a second surface 122 disposed oppositely. The first terminal module 2 is disposed on the first surface 121, the second terminal module 3 is disposed on the second surface 122 and the shielding member 4 is disposed in the tongue portion and located between the first and second surfaces, the first terminal module 2 includes two grounding contacts 21 and the grounding contact 21 defines a connecting portion 211 extending to the shielding member 4 and contacting the shielding member 4.

Referring to FIG. 3 to FIG. 6, the electrical connector 100 further includes a mating plate 13 and an insulative frame 14. The first terminal module 2 includes a first insulative housing 22 and a plurality of first terminals 20 retained in the first insulative housing 22, the first insulative housing 22 defines a blocking portion 221 in the rear region thereof and a pair of engaging portions 222 projecting from both sides of the blocking portion 221. The first terminals 20 are integrally molded to the first insulative housing 22 and include said two grounding contacts 21 and a plurality of pairs of differential signal terminals 23, wherein two pairs of differential signal terminals 23 are adjacent to each other and the grounding contacts 21 is located between said two pairs of differential signal terminals 23 disposed adjacent. The connecting portion 211 is formed by the grounding contact 21 bent toward to the shielding member 4 in order to obtain reliable contacting between the connecting portions 211 and the shielding member 4. The first terminal module 2 is arranged on the first surface 121 of the tongue portion 12 in a longitudinal direction and the grounding contact 21 defines a free end in the front thereof to form a stopper portion 213, a contacting portion 212 located between the connecting portion 211 and the stopper portion 213 and a soldering foot located in rear side of the connecting portion 211 and extending outside of the insulative housing 1. The contacting portion 212 is located in front of the connecting portion 211 and the width of the contacting portion 212 in the longitudinal direction is same as the width of the connecting portion 211 in the longitudinal direction.

The second terminal module 3 includes a second insulative housing 32 and a plurality of second terminals 31 retained in the second insulative housing 32, the second insulative housing 32 defines a pair of locking portions 321 extending upwardly from both sides thereof. The shielding member 4 is integrally molded to the mating plate 13 and includes body portion 41 and a soldering portion extending downwardly from the rear region of the body portion 41. The first terminal module 2 and the second terminal module 3 are mounted on both sides of the mating plate 13 and assembled forwardly to the insulative frame 14 to form the insulative housing 1. The front end of the mating plate 13 is running through the frame 14 and located in front of the frame 14 to form the tongue portion 12, the second terminal module 3 is exposed to the second surface 12 of the tongue portion 122, the connecting portion 211 of the ground contact 21 is located inside of the base portion 11 of the insulative housing 1 and not projecting outside of the front face 110 of the base portion 11. The second insulative housing 32 is locked both sides of the mating plate 13 by the locking portions 321 to be fixed to the mating plate 13, the blocking portion 221 of the first insulative housing 22 is located in rear side of the mating plate 13 and the first insulative housing 22 is retained in the insulative frame 14 by the engaging portions 222.

The body portion 41 of the shielding member 4 is disposed in the tongue portion 12 and located between the first surface 121 and the second surface 122, the connecting portion 211 is running through a through-hole 123 located in the base portion 11 and contacting the body portion 41 of the shielding member 4. The stopper portion 213 of the ground contact 21 is locked the front end of the tongue portion 12 to prevent the front end of the grounding contact 21 upturned, the body portion 41 defines a notch 410 corresponding to the stopper portion 213 in the front thereof and avoid the stopper portion 213 contacts with the notch 410, and thus prevents short-circuiting of the electrical connector. The body portion 41 of the shielding member 4 is full plane shape and has a large flat area, and the contact portion 211 of the ground terminal 21 is electrically contacting with the shield member 4 so that it can reduce the signal interference between the differential signal terminals 23 of the first terminal module 2, and also reduce the signal interference between the first terminals 20 of the first terminal module 2 and the second terminals 31 of the second terminal module 3. It is conducive to the high-frequency signal transmission between the electrical connector 100 and the external devices, and thereby helping to improve the high frequency performance of the electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a base portion and a tongue portion extending forwardly from the base portion, the tongue portion defining a first surface and a second surface disposed oppositely;

a first terminal module retained in the insulative housing and exposed on the first surface; and a shielding member embedded in the tongue portion of the insulative housing and located between the first surface and the second surface;

wherein the first terminal module defines at least one grounding contact; wherein the grounding contact has a free end to form a stopper portion clasping the tongue portion, and the shielding member defines a notch corresponding to the stopper portion in the front thereof.

2. The electrical connector as described in claim 1, wherein the grounding contact defines a connecting portion projecting toward and contacting the shielding member, and the connecting portion is bent toward the shielding member, the insulative housing defines at least one through-holes and the connecting portion is running through the corresponding through-hole and contacting with the shielding member.

3. The electrical connector as described in claim 2, wherein the first terminal module is arranged on the first surface of the tongue portion in a longitudinal direction and defines a free end located in front thereof and a contacting portion located between the connecting portion and the free end, the width of the contacting portion in the longitudinal direction is same as the width of the connecting portion in the longitudinal direction.

4. The electrical connector as described in claim 2, wherein the connecting portion of the grounding contact is located inside of the base portion of the insulative housing and not projecting outside of the front face of the base portion.

5. The electrical connector as described in claim 2, wherein the shielding member defines a plate-shaped body portion and a soldering portion extending outside of the insulative housing, the body portion is disposed in the tongue portion and located between the first surface and the second surface, and the connecting portion is contacting with the body portion of the shielding member.

6. The electrical connector as described in claim 2, wherein the grounding contact defines a contacting portion located in front of the connecting portion and a soldering foot located in rear side of the connecting portion, the first terminal module further includes two pairs of differential signal terminals adjacent to each other, and the grounding contact is located between said two pairs of differential signal terminals disposed adjacent thereto.

7. An electrical connector assembly comprising:

an insulative housing defining a receiving cavity;

a terminal module assembly received in the receiving cavity, said housing and said terminal module assembly being configured to allow said terminal module assembly to be inserted into the receiving cavity only forwardly along a front-to-back direction, said terminal module assembly including an upper terminal module and a lower terminal module commonly sandwiching an insulative mating plate therebetween in a vertical direction perpendicular to said front-to-back direction, the upper terminal module equipped with a plurality of upper contacts insert-molded within an upper insulator wherein front mating sections of the upper contacts are exposed upon an upper surface of the mating plate, the lower terminal module equipped with a plurality of lower contacts insert-molded within a lower insulator wherein front mating sections of the lower contacts are exposed upon a lower surface of the mating plate, a metallic shielding plate embedded within the mating plate, the mating plate being sandwiched between the upper insulator of the upper terminal module and the lower insulator of the lower terminal module in the vertical direction; wherein the mating plate independently defines a downward facing recess to receive the insulator of the lower terminal module therein, and said mating plate and the lower terminal module are configured to allow the lower insulator of the lower terminal module to be assembled to the mating plate only upwardly along said vertical direction.

8. The electrical connector assembly as claimed in claim 7, wherein the lower terminal module includes a pair of locking portions to be received within corresponding notches of the mating plate.

9. The electrical connector assembly as claimed in claim 7, wherein the housing is of a frame structure to form said receiving cavity.

10. The electrical connector assembly as claimed in claim 7, wherein said upper contacts and said lower contacts include at least one grounding contact having a front free end to form a stopper portion clasping the mating plate, and the shielding plate defines a notch corresponding to the stopper portion around a front edge region.

11. The electrical connector assembly as claimed in claim 7, wherein the upper terminal module and the mating plate are configured to allow the upper terminal module to be assembled to the mating plate only downwardly along the vertical direction.

12. The electrical connector assembly as claimed in claim 11, wherein the mating plate defines an downward indent in the upper surface, and a contact of said upper contacts defines a downward protrusion to be received in the indent and mechanically and electrically connected to the shielding plate.

13. The electrical connector assembly as claimed in claim 11, wherein said upper insulator forms engaging portions to be received in corresponding notches in the housing to restrain forward and vertical movement of the upper insulator.

14. An electrical connector assembly comprising:

an insulative housing defining a receiving cavity;

a terminal module assembly received in the receiving cavity, said housing and said terminal module assembly being configured to allow said terminal module assembly to be inserted into the receiving cavity only forwardly along a front-to-back direction, said terminal module assembly including an upper terminal module and a lower terminal module commonly sandwiching an insulative mating plate therebetween in a vertical direction, the upper terminal module equipped with a plurality of upper contacts insert-molded within an upper insulator wherein front mating sections of the upper contacts are exposed upon an upper surface of the mating plate, the lower terminal module equipped with a plurality of lower contacts insert-molded within a lower insulator wherein front mating sections of the lower contacts are exposed upon a lower surface of the mating plate, a metallic shielding plate embedded within the mating plate, wherein the mating plate defines an downward indent in the upper surface, and a contact of said upper contacts defines a downward protrusion to be received in the indent and mechanically and electrically connected to the shielding plate.

15. The electrical connector assembly as claimed in claim 14, wherein said upper contacts and said lower contacts include at least one grounding contact having a front free end to form a stopper portion clasping the mating plate, and the shielding plate defines a notch corresponding to the stopper portion around a front edge region.

16. The electrical connector assembly as claimed in claim 14, wherein said upper terminal module and the mating plate are configured to allow the upper terminal module to be assembled to the mating plate only downwardly along a vertical direction perpendicular to said front-to-back direction.

17. The electrical connector assembly as claimed in claim 16, wherein said lower insulator is only engaged with the mating plate while said upper insulator is engaged with the mating plate and the housing, while not with the lower insulator.

* * * * *